US010781663B2

(12) United States Patent
De La Cruz et al.

(10) Patent No.: US 10,781,663 B2
(45) Date of Patent: Sep. 22, 2020

(54) SLIDING SLEEVE INCLUDING A SELF-HOLDING CONNECTION

(71) Applicants: Carlos De La Cruz, Houston, TX (US); Sean Gaudette, Katy, TX (US); Robert O'Brien, Katy, TX (US)

(72) Inventors: Carlos De La Cruz, Houston, TX (US); Sean Gaudette, Katy, TX (US); Robert O'Brien, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 73 days.

(21) Appl. No.: 16/035,287

(22) Filed: Jul. 13, 2018

(65) Prior Publication Data

US 2020/0018137 A1 Jan. 16, 2020

(51) Int. Cl.

*E21B 34/14* (2006.01)
*E21B 34/10* (2006.01)
*E21B 34/06* (2006.01)

(52) U.S. Cl.

CPC ..... *E21B 34/14* (2013.01); *E21B 34/063* (2013.01); *E21B 34/10* (2013.01); *E21B 34/103* (2013.01); *E21B 2200/06* (2020.05)

(58) Field of Classification Search

CPC ..... E21B 34/14; E21B 34/10; E21B 34/063; E21B 2034/007

See application file for complete search history.

(56) References Cited

U.S. PATENT DOCUMENTS 4,979,568 A * 12/1990 Spencer ..... E21B 23/006 166/321
2002/0062962 A1 5/2002 Gary et al.
2005/0126787 A1 6/2005 Gomez
2013/0068451 A1* 3/2013 Getzlaf ..... E21B 43/00 166/250.07
2015/0167431 A1 6/2015 Purkis et al.
2015/0226017 A1* 8/2015 Telfer ..... E21B 37/00 175/57
2017/0044870 A1 2/2017 Kellner et al.

FOREIGN PATENT DOCUMENTS

WO 2010127457 A1 11/2010

OTHER PUBLICATIONS

International Search Report and Written Opinion for International Application No. PCT/US2019/041300; International filing Date Jul. 11, 2019; dated Oct. 30, 2019 (pp. 1-10).

* cited by examiner

*Primary Examiner* — D. Andrews
*Assistant Examiner* — Manuel C Portocarrero
(74) *Attorney, Agent, or Firm* — Cantor Colburn LLP

(57) ABSTRACT

A tubular includes an outer surface, an inner surface defining a passage, and a plurality of openings extending through the outer surface and the inner surface. A sleeve is positioned within the passage. The sleeve includes an outer surface portion having at least one recess. At least one release member extends from the inner surface into the at least one recess. The at least one release member maintains the sleeve in a first configuration relative to the plurality of openings. At least one of the inner surface and the outer surface portion includes a self-holding connection that establishes one of a reduced diameter portion of the passage and an increased diameter portion of the sleeve. The self-holding connection is configured to maintain the sleeve in a second configuration axially shifted relative to the first configuration.

14 Claims, 5 Drawing Sheets

SLIDING SLEEVE INCLUDING A SELF-HOLDING CONNECTION

BACKGROUND

In the resource exploration and recovery industry, it is often desirable to establish a fluid flow path between a tubular and a formation. In many systems, a sliding sleeve is shifted from a first position to a second position to either cover or uncover ports formed in the tubular. The sleeve may include a ball seat that is receptive of a plug. The drop ball is introduced into the tubular and directed toward the seat. Once in position, pressure may be applied to the ball causing the sleeve to move.

The pressure applied to the ball is set to overcome a frangible element, such as a shear screw, that maintains the sleeve in the closed configuration. Once shifted, another element or elements, such as a retention element, maintains the sleeve in the open configuration. In addition to maintaining the sleeve in the open configuration, the retention element(s) rotationally locks the sleeve to the tubular. With the sleeve rotationally locked, a tool guided downhole is able to drill through the ball seat, if desired. The use and installation of retention elements increases an overall manufacturing cost and complexity of the tubular as well as any mating components. Accordingly, the industry would be receptive to alternative systems for maintaining a sleeve in position after shifting.

SUMMARY

In accordance with an exemplary embodiment, a tubular includes an outer surface, an inner surface defining a passage, and a plurality of openings extending through the outer surface and the inner surface. A sleeve is positioned within the passage. The sleeve includes an outer surface portion having at least one recess. At least one release member extends from the inner surface into the at least one recess. The at least one release member maintains the sleeve in a first configuration relative to the plurality of openings. At least one of the inner surface and the outer surface portion includes a self-holding connection that establishes one of a reduced diameter portion of the passage and an increased diameter portion of the sleeve. The self-holding connection is configured to maintain the sleeve in a second configuration axially shifted relative to the first configuration.

In accordance with another aspect of an exemplary embodiment, a downhole system includes a first system, and a second system fluidically connected to the first system through one or more tubulars. At least one of the one or more tubulars includes an outer surface, an inner surface defining a passage, and a plurality of openings extending through the outer surface and the inner surface. A sleeve is positioned within the passage. The sleeve includes an outer surface portion having at least one recess. At least one release member extends from the inner surface into the at least one recess. The at least one release member maintains the sleeve in a first configuration relative to the plurality of openings. At least one of the inner surface and the outer surface portion includes a self-holding connection that establishes one of a reduced diameter portion of the passage and an increased diameter portion of the sleeve. The self-holding connection is configured to maintain the sleeve in a second configuration axially shifted relative to the first configuration.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
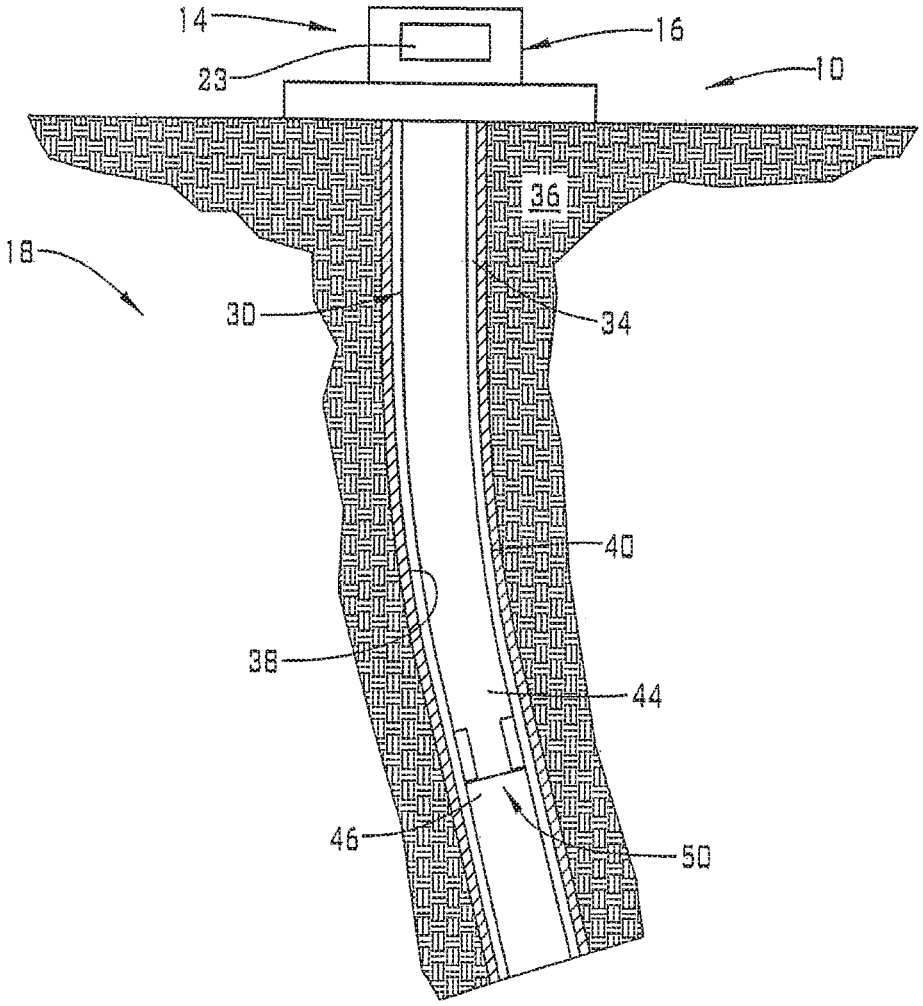
FIG. 1 depicts a resource exploration and recovery system including a sliding sleeve having a self-holding connection, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in a formation 36. Wellbore 34 includes an annular wall 38 which may be defined by a surface of formation 36, or, in the embodiment shown, by a casing tubular 40.

Tubular string 30 may be formed by a series of interconnected discrete tubulars, two of which are indicated at 44 and 46, or by a single tubular that could take the form of coiled tubing. Tubular string 30 may support a slidable sleeve 50 that selectively covers one or more openings or ports 56 (FIG. 2) formed in, for example, tubular 44.

Figure 2:
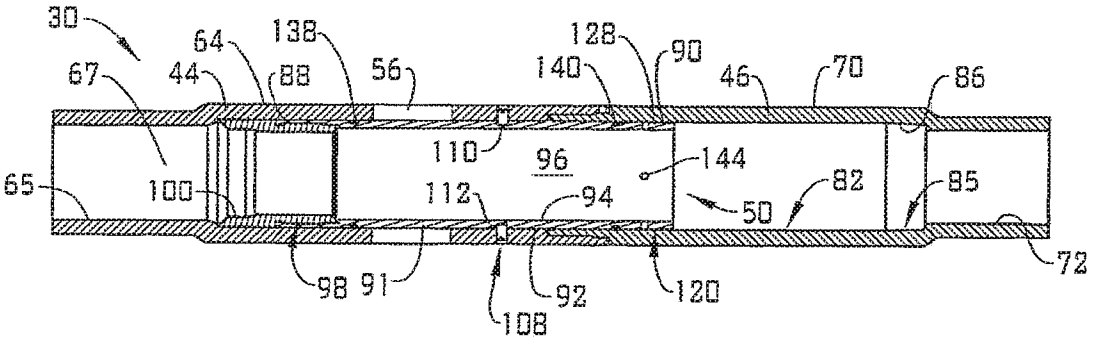
FIG. 2 depicts the sleeve prior to sliding, in accordance with an aspect of an exemplary embodiment.
Figure 3:
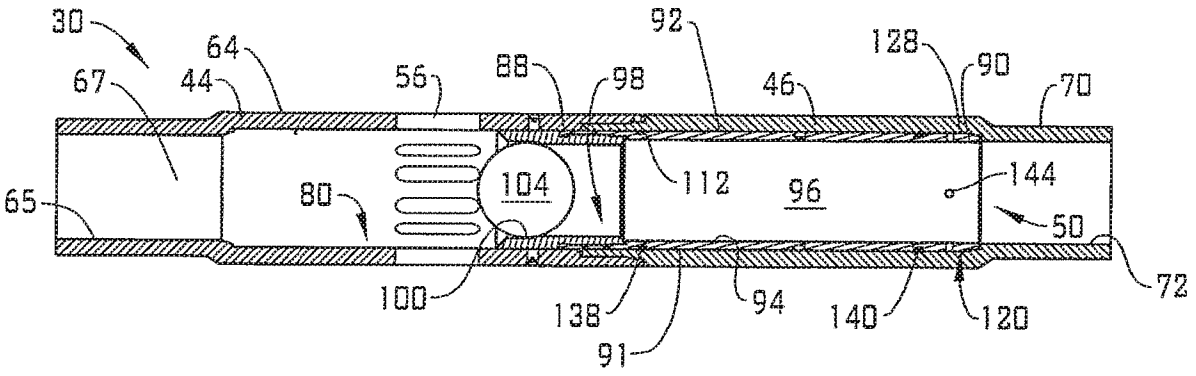
FIG. 3 depicts the self-holding connection retaining the sleeve after shifting, in accordance with an aspect of an exemplary embodiment.

Referring to FIGS. 2-3, and with continued reference to FIG. 1, tubular 44 includes a first outer surface 64 and a first inner surface 65 that defines a passage 67. Tubular 46 is connected to tubular 44 and includes a second outer surface 70 and a second inner surface 72 that also defines passage 67. First inner surface 65 includes a first sleeve receiving recess portion 80 and second inner surface 72 includes a second sleeve receiving recess portion 82. Slidable sleeve 50 is positioned in first and second sleeve receiving recess portions 80 and 82. Second inner surface 72 includes a reduced diameter portion 85 that defines a first containment element 86. As will be detailed herein, first containment element 86 provides structure for securing slidable sleeve 50 to tubular 46.

In accordance with an exemplary embodiment, slidable sleeve 50 includes a first end 88, a second end 90 and an intermediate portion 91 extending therebetween. Slidable sleeve 50 includes an outer surface portion 92 and an inner surface portion 94 that defines a passageway 96 that registers with, and is fluidically connected to, passage 67. A plug seat 98, shown in the form of a ball seat, is mounted to first end 88. While shown at first end 88, it should be understood that plug seat 98 could be mounted at second end 90. Plug seat 98 includes a reduced diameter zone 100 that is receptive of a plug such as a drop ball 104 that is employed to actuate or shift slidable sleeve 50. In an embodiment, slidable sleeve 50 may shift from a first position covering ports 56 to a second position in which ports 56 are uncovered. It should be understood that, in an alternate embodiment, slidable sleeve 50 may also be shifted to cover instead of uncover ports 56.

In further accordance with an embodiment, slidable sleeve 50 is secured in passage 67 covering ports 56 by one or more release members 108 shown in the form of shear screws 110. Of course, it should be understood that other forms of release members may be employed. Shear screws 110 extend into a recess 112 that is formed in outer surface portion 92. In operation, drop ball 104 is introduced into tubular string 30 from first system 14. Drop ball 104 moves along passage 67 and may come to rest at reduced diameter zone 100 of ball seat 98. Pressure is applied to drop ball 104 causing release member 108 to be activated allowing slidable sleeve 50 to shift from a first configuration, in which ports 56 are covered, along passage 67 to a second configuration uncovering ports 56.

Figure 4:
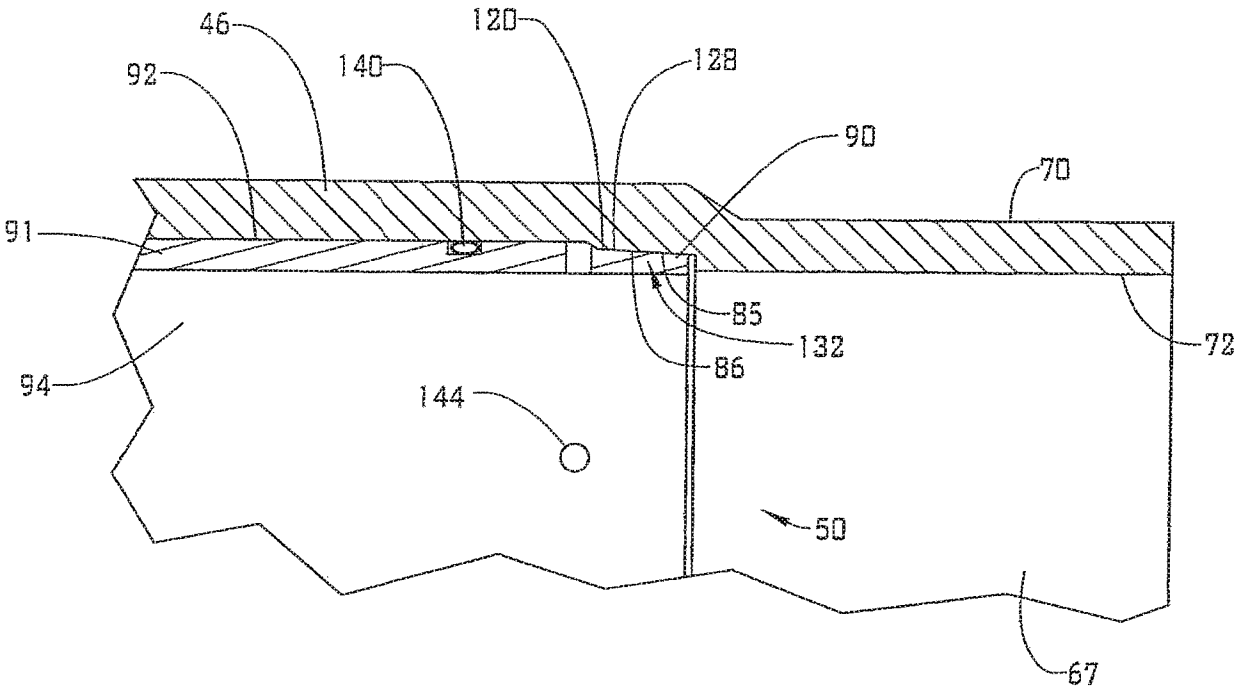
FIG. 4 depicts a detail view of the self-holding connection, in accordance with an aspect of an exemplary embodiment.
Figure 5:
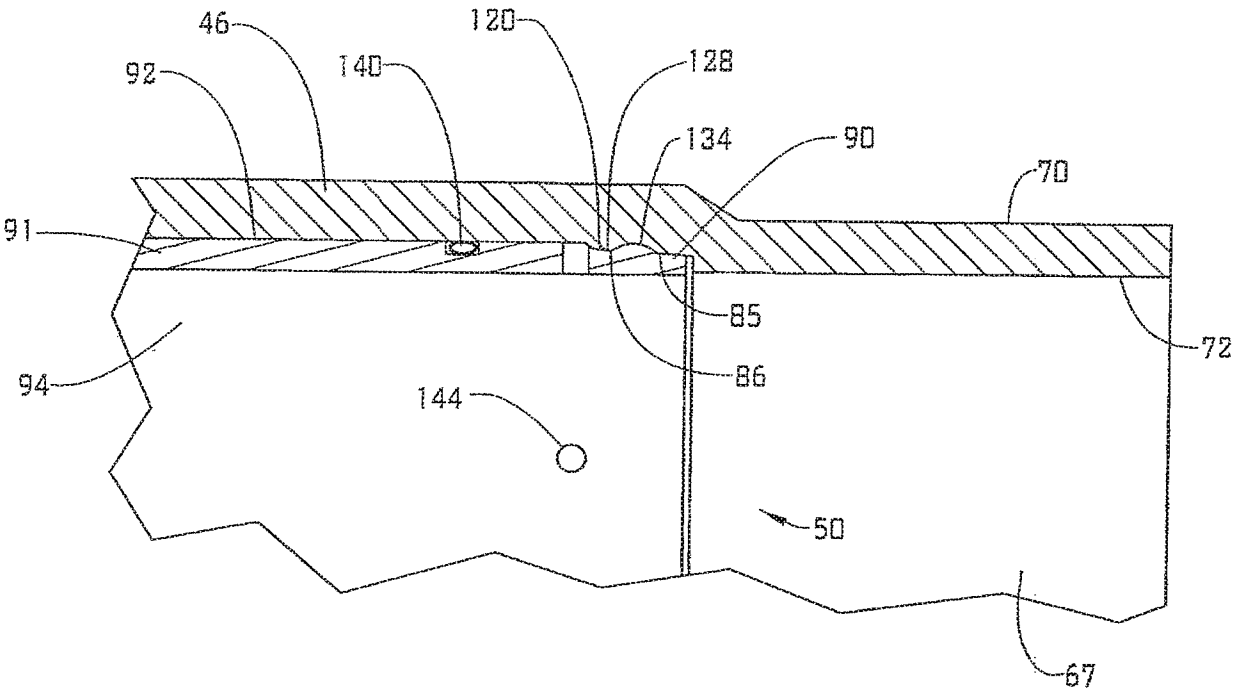
FIG. 5 depicts a detail view of the self-holding connection, in accordance with another aspect of an exemplary embodiment.

In still further accordance with an exemplary embodiment, slidable sleeve 50 may include a second containment element 128 at second end 90. Second containment element 128 may take the form of an increased diameter portion. First containment element 86 and second containment element 128 cooperate to form a self-holding connection (not separately labeled) that retains slidable sleeve 50 in the second configuration. The self-holding connection may take on a variety of forms including, but not limited to, a press fit connection, an interference fit connection, and a self-holding taper including a Morse taper 132 such as shown in FIG. 4 or a projection that may be defined by an annular rib 134 as shown in FIG. 5.

The interference fit not only prevents slidable sleeve 50 from shifting axially, but also effectively transmits torque thereby preventing relative rotation. In this manner, slidable sleeve 50 and/or plug seat 98 may be bored out and removed, if so desired. In an embodiment, the self-holding connection possesses a shallow angle which cooperates with first containment element 86 to hold torque loads that may be applied to slidable sleeve 50 during removal operations. Further, the ability of the self-holding connection to hold torque increases with axial loading. Thus, increasing a downward force on tubular 44 increases an overall torque holding capability of containment feature 132 thereby allowing for the removal of slidable sleeve 50 and/or plug seat 98.

Slidable sleeve 50 is also shown to support a first seal 138 and a second seal 140. First and second seals 138 and 140 help ensure that slidable sleeve 50 seals ports 56 when in the first configuration. When shifting, first and second seals 138 and 140 may create a pressure increase as annular rib 128 engages with reduced diameter portion 85. Thus, in accordance with an exemplary aspect, slidable sleeve 50 may include one or more pressure relief orifices 144 arranged proximate to second end 90.

At this point, it should be understood that the exemplary embodiments describes a containment feature that maintains a slidable sleeve in a post activation position. The containment feature prevents the sleeve from returning to a pre-activation state, where ports 56 may be covered, while also acting as a torque transmitter. That is, the containment feature prevents rotation of the slidable sleeve post activation to promote removal, if desired. Further, the containment feature secures the sleeve without the need for additional parts, manufacturing operations, and/or assembly steps.

Set forth below are some embodiments of the foregoing disclosure:

Embodiment 1

A tubular including: an outer surface, an inner surface defining a passage, and a plurality of openings extending through the outer surface and the inner surface; a sleeve positioned within the passage, the sleeve including an outer surface portion having at least one recess; and at least one release member extending from the inner surface into the at least one recess, the at least one release member maintaining the sleeve in a first configuration relative to the plurality of openings, wherein at least one of the inner surface and the outer surface portion includes a self-holding connection that establishes one of a reduced diameter portion of the passage and an increased diameter portion of the sleeve, the self-holding connection being configured to maintain the sleeve in a second configuration axially shifted relative to the first configuration.

Embodiment 2

The tubular as in any prior embodiment, wherein the self-holding connection comprises a projection formed on the outer surface portion of the sleeve.

Embodiment 3

The tubular as in any prior embodiment, wherein the projection defines an annular rib.

Embodiment 4

The tubular as in any prior embodiment, wherein the sleeve includes a first end, a second end, and an intermediate portion, the first end including a ball seat.

Embodiment 5

The tubular as in any prior embodiment, wherein the self-holding connection comprises a Morse taper formed at the second end of the sleeve.

Embodiment 6

The tubular as in any prior embodiment, wherein the sleeve includes one or more pressure relief orifices arranged at the second end.

Embodiment 7

The tubular as in any prior embodiment, wherein the self-holding connection includes a first containment feature defining an increased diameter portion of the sleeve and a second containment feature defining a reduced diameter portion of the passage.

Embodiment 8

The tubular as in any prior embodiment, wherein the tubular includes a first tubular member joined to a second tubular member, the openings being formed in the first tubular member and the second containment feature being formed in the second tubular member.

Embodiment 9

The tubular as in any prior embodiment, further including: at least one seal extending about the sleeve.

Embodiment 10

The tubular according as in any prior embodiment, wherein the at least one release member comprises a shear screw.

Embodiment 11

A downhole system including: a first system; and a second system fluidically connected to the first system through one or more tubulars, at least one of the one or more tubulars including: an outer surface, an inner surface defining a passage, and a plurality of openings extending through the outer surface and the inner surface; a sleeve positioned within the passage, the sleeve including an outer surface portion having at least one recess; and at least one release member extending from the inner surface into the at least one recess, the at least one release member maintaining the sleeve in a first configuration relative to the plurality of openings, wherein at least one of the inner surface and the outer surface portion includes a self-holding connection that establishes one of a reduced diameter portion of the passage and an increased diameter portion of the sleeve, the self-holding connection being configured to maintain the sleeve in a second configuration axially shifted relative to the first configuration.

Embodiment 12

The downhole system as in any prior embodiment, wherein the self-holding connection comprises a projection formed on the outer surface portion of the sleeve.

Embodiment 13

The downhole system as in any prior embodiment, wherein the projection defines an annular rib.

Embodiment 14

The downhole system as in any prior embodiment, wherein the sleeve includes a first end, a second end, and an intermediate portion, the first end including a ball seat.

Embodiment 15

The downhole system as in any prior embodiment, wherein the self-holding connection comprises a Morse taper formed at the second end of the sleeve.

Embodiment 16

The downhole system as in any prior embodiment, wherein the sleeve includes one or more pressure relief orifices arranged at the second end.

Embodiment 17

The downhole system as in any prior embodiment, wherein the self-holding connection includes a first containment feature defining an increased diameter portion of the sleeve and a second containment feature defining a reduced diameter portion of the passage.

Embodiment 18

The downhole system as in any prior embodiment, wherein the tubular includes a first tubular member joined to a second tubular member, the openings being formed in the first tubular member and the second containment feature being formed in the second tubular member.

Embodiment 19

The downhole system as in any prior embodiment, further comprising: at least one seal extending about the sleeve.

Embodiment 20

The downhole system as in any prior embodiment, wherein the at least one release member comprises a shear screw.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A tubular comprising:

an outer surface, an inner surface defining a passage, and a plurality of openings extending through the outer surface and the inner surface, the inner surface including an annular recess;

a sleeve positioned within the passage, the sleeve including a first end, a second end, and an intermediate portion having an outer surface portion extending between the first end and the second end, the outer surface including at least one recess, the sleeve further including a pressure relief orifice spaced from the second end and an annular rib projecting radially outwardly of the outer surface between the second end and the pressure relief orifice, wherein the annular projection selectively nests within the annular recess to establish a self-holding connection; and at least one release member extending from the inner surface into the at least one recess, the at least one release member maintaining the sleeve in a first configuration relative to the plurality of openings, wherein the self-holding connection is configured to axially and rotationally maintain the sleeve in a second configuration axially shifted relative to the first configuration.

2. The tubular according to claim 1, wherein the first end of the sleeve includes a ball seat.

3. The tubular according to claim 1, wherein the self-holding connection further includes a Morse taper formed at the second end of the sleeve.

4. The tubular according to claim 1, wherein the self-holding connection further includes a first containment feature defining an increased diameter portion of the sleeve and a second containment feature defining a reduced diameter portion of the passage.

5. The tubular according to claim 4, wherein the tubular includes a first tubular member joined to a second tubular member, the openings being formed in the first tubular member and the second containment feature being formed in the second tubular member.

6. The tubular according to claim 1, further comprising: at least one seal extending about the sleeve.

7. The tubular according to claim 1, wherein the at least one release member comprises a shear screw.

8. A downhole system comprising:

a first system; and a second system fluidically connected to the first system through one or more tubulars, at least one of the one or more tubulars comprising:

an outer surface, an inner surface defining a passage, and a plurality of openings extending through the outer surface and the inner surface, the inner surface including an annular recess;

a sleeve positioned within the passage, the sleeve including a first end, a second end, and an intermediate portion having an outer surface portion extending between the first end and the second end, the outer surface including at least one recess, the sleeve further including a pressure relief orifice spaced from the second end and an annular rib projecting radially outwardly of the outer surface between the second end and the pressure relief orifice, wherein the annular projection selectively nests within the annular recess to establish a self-holding connection; and at least one release member extending from the inner surface into the at least one recess, the at least one release member maintaining the sleeve in a first configuration relative to the plurality of openings, wherein the self-holding connection is configured to axially and rotationally maintain the sleeve in a second configuration axially shifted relative to the first configuration.

9. The downhole system according to claim 8, wherein the first end includes a ball seat.

10. The downhole system according to claim 8, wherein the self-holding connection further includes a Morse taper formed at the second end of the sleeve.

11. The downhole system according to claim 8, wherein the self-holding connection further includes a first containment feature defining an increased diameter portion of the sleeve and a second containment feature defining a reduced diameter portion of the passage.

12. The downhole system according to claim 11, wherein the tubular includes a first tubular member joined to a second tubular member, the openings being formed in the first tubular member and the second containment feature being formed in the second tubular member.

13. The downhole system according to claim 8, further comprising: at least one seal extending about the sleeve.

14. The downhole system according to claim 8, wherein the at least one release member comprises a shear screw.

* * * * *